US008511809B2

(12) United States Patent
Yunoki et al.

(10) Patent No.: US 8,511,809 B2
(45) Date of Patent: Aug. 20, 2013

(54) DAMPING DEVICE, LIQUID SUPPLYING APPARATUS, AND DROPLET DISCHARGING APPARATUS

(75) Inventors: Kousuke Yunoki, Kanagawa (JP); Masaki Kataoka, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 185 days.

(21) Appl. No.: 13/089,962

(22) Filed: Apr. 19, 2011

(65) Prior Publication Data

US 2012/0140006 A1 Jun. 7, 2012

(30) Foreign Application Priority Data

Dec. 3, 2010 (JP) ..... 2010-270628

(51) Int. Cl.
*B41J 2/17* (2006.01)

(52) U.S. Cl.
USPC ..... 347/94

(58) Field of Classification Search
USPC ..... 347/94
See application file for complete search history.

(56) References Cited

U.S. PATENT DOCUMENTS

| | | | | |
|---|---|---|---|---|
| 2005/0088494 | A1* | 4/2005 | Shimizu et al. | 347/85 |
| 2008/0238979 | A1* | 10/2008 | Umeda | 347/17 |
| 2010/0214384 | A1* | 8/2010 | Takata | 347/94 |

FOREIGN PATENT DOCUMENTS

| | | |
|---|---|---|
| JP | A-9-277561 | 10/1997 |
| JP | A-2005-125635 | 5/2005 |
| JP | B2-4284516 | 6/2009 |
| JP | A-2009-184183 | 8/2009 |

* cited by examiner

*Primary Examiner* — Julian Huffman
*Assistant Examiner* — Sharon A Polk
(74) *Attorney, Agent, or Firm* — Oliff & Berridge, PLC

(57) ABSTRACT

A damping device includes an elastic membrane that serves as a wall of a part of a supply channel between a reservoir unit that contains liquid and a droplet discharging unit that discharges the liquid in the form of a droplet; a wall portion provided outside of the supply channel such that a gas chamber is provided between the wall portion and the elastic membrane; and a resistance unit provided on the wall portion, the resistance unit providing ventilation and generating a resistance force against a movement of the elastic membrane.

14 Claims, 14 Drawing Sheets

DAMPING DEVICE, LIQUID SUPPLYING APPARATUS, AND DROPLET DISCHARGING APPARATUS

CROSS-REFERENCE TO RELATED APPLICATIONS

This application is based on and claims priority under 35 USC 119 from Japanese Patent Application No. 2010-270628 filed Dec. 3, 2010.

BACKGROUND

The present invention relates to a damping device, a liquid supplying apparatus, and a droplet discharging apparatus.

SUMMARY

According to an aspect of the invention, there is provided a damping device including an elastic membrane that serves as a wall of a part of a supply channel between a reservoir unit that contains liquid and a droplet discharging unit that discharges the liquid in the form of a droplet; a wall portion provided outside of the supply channel such that a gas chamber is provided between the wall portion and the elastic membrane; and a resistance unit provided on the wall portion, the resistance unit providing ventilation and generating a resistance force against a movement of the elastic membrane.

BRIEF DESCRIPTION OF THE DRAWINGS

An exemplary embodiment of the present invention will be described in detail based on the following figures, wherein.

DETAILED DESCRIPTION

First Exemplary Embodiment

A damping device, a liquid supplying apparatus, and a droplet discharging apparatus according to a first exemplary embodiment of the present invention will be described.

Figure 1:
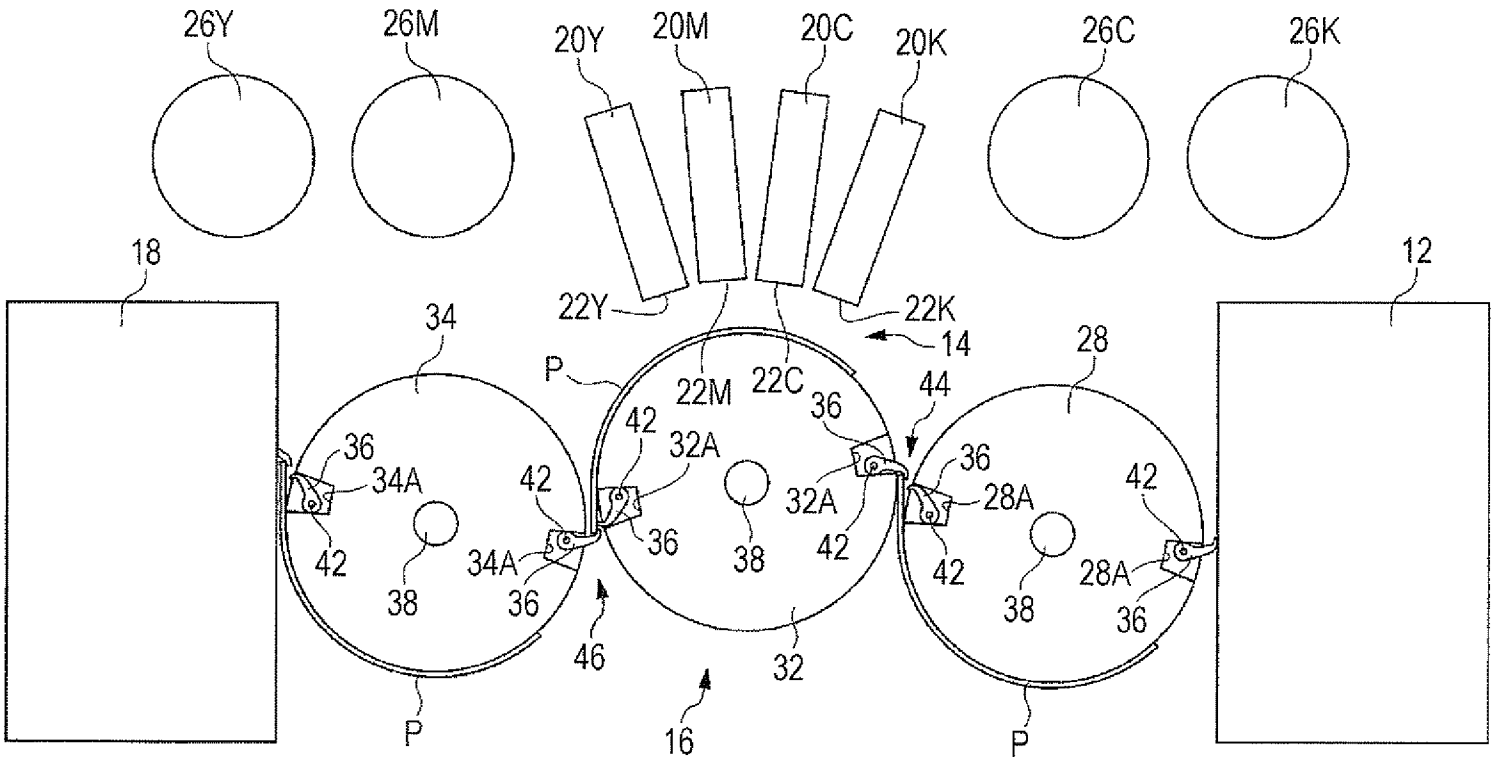
FIG. 1 is a schematic diagram illustrating the structure of an inkjet recording apparatus according to a first exemplary embodiment.

FIG. 1 shows an inkjet recording apparatus 10 as an example of a droplet discharging apparatus that records images on recording media P by discharging ink droplets as an example of droplets. The inkjet recording apparatus 10 includes a storage unit 12 that stores the recording media P, an image recording unit 14 that record images on the recording media P, a transporting unit 16 that transports the recording media P from the storage unit 12 to the image recording unit 14, and an ejection unit 18 to which the recording media P are ejected after the images are recorded on the recording media P by the image recording unit 14.

The image recording unit 14 includes inkjet heads 20Y, 20M, 20C, and 20K as an example of liquid supplying apparatuses. The inkjet heads 20Y, 20M, 20C, and 20K have nozzle surfaces 22Y, 22M, 22C, and 22K, respectively, in which nozzles 24 (see FIG. 2) are formed as an example of discharge orifices. Each of the nozzle surfaces 22Y, 22M, 22C, and 22K has a recordable area with a width larger than or equal to the maximum width of the recording media P on which images may be recorded by the inkjet recording apparatus 10.

The inkjet heads 20Y, 20M, 20C, and 20K are arranged in the order of yellow (Y), magenta (M), cyan (C), and black (K) from the downstream side in a transporting direction of the recording media P. The inkjet heads 20Y, 20M, 20C, and 20K discharge ink droplets of respective colors through the nozzles 24 (see FIG. 2) by a piezoelectric method. Thus, an image is formed on each recording medium P. The inkjet heads 20Y, 20M, 20C, and 20K may discharge the ink droplets by a method other than the piezoelectric method, such as a thermal method. In the following description, the letters 'Y', 'M', 'C', and 'K' are omitted when it is not necessary to distinguish the components corresponding to the respective colors.

The inkjet recording apparatus 10 includes main tanks 56 that function as reservoir units that contain ink, which is as an example of liquid, of respective colors. The ink of respective colors is supplied from the main tanks 56Y, 56M, 56C, and 56K to the inkjet heads 20Y, 20M, 20C, and 20K, respectively. Various types of inks, such as aqueous ink, oil-based ink, and solvent-based ink may be used as the ink supplied to the inkjet heads 20Y, 20M, 20C, and 20K.

The transporting unit 16 includes a take-out drum 28 that takes out the recording media P from the storage unit 12 one at a time; a transporting drum 32 that functions as a transporting body that transports each recording medium P to the inkjet heads 20Y, 20M, 20C, and 20K in the image recording unit 14 and causes a recording surface of the recording medium P to face the inkjet heads 20Y, 20M, 200, and 20K; and an ejecting drum 34 that ejects the recording medium P on which an image is recorded to the ejection unit 18. The take-out drum 28, the transporting drum 32, and the ejecting drum 34 are capable of retaining the recording media P on the outer peripheral surfaces thereof by using an electrostatic retaining unit or a non-electrostatic retaining unit, such as a suction unit or an adhesion unit.

Each of the take-out drum 28, the transporting drum 32, and the ejecting drum 34 is provided with two sets of grippers 36 that are spaced from each other in a circumferential direction. The grippers 36 are capable of gripping the downstream ends of the recording media P in the transporting direction. Each of the take-out drum 28, the transporting drum 32, and the ejecting drum 34 is capable of retaining up to two recording media P on the outer peripheral surface thereof with the grippers 36. The grippers 36 are disposed in pairs of recesses 28A, 32A, and 34A formed in the outer peripheral surfaces of the take-out drum 28, the transporting drum 32, and the ejecting drum 34, respectively.

More specifically, rotational shafts 42 are supported at predetermined positions in the recesses 28A, 32A, and 34A so as to extend along rotational shafts 38 of the take-out drum 28, the transporting drum 32, and the ejecting drum 34. Each rotational shaft 42 has plural grippers 36 fixed thereto with intervals therebetween in the axial direction. The rotational shafts 42 are rotated by actuators (not shown) in a normal direction (for example, clockwise in FIG. 1) or a reverse direction (for example, counterclockwise in FIG. 1). Accordingly, the grippers 36 are rotated in a normal or reverse direction along the circumferential direction of the take-out drum 28, the transporting drum 32, and the ejecting drum 34. Thus, the grippers 36 grip or release the downstream ends of the recording media P in the transporting direction.

The grippers 36 are rotated such that end portions thereof slightly project from the outer peripheral surfaces of the take-out drum 28, the transporting drum 32, and the ejecting drum 34. The recording media P are passed from the grippers 36 on the take-out drum 28 to the grippers 36 on the transporting drum 32 at a transfer position 44 at which the outer peripheral surfaces of the take-out drum 28 and the transporting drum 32 face with each other. Similarly, the recording media P are passed from the grippers 36 on the transporting drum 32 to the grippers 36 on the ejecting drum 34 at a transfer position 46 at which the outer peripheral surfaces of the transporting drum 32 and the ejecting drum 34 face each other.

The inkjet recording apparatus 10 also includes a maintenance unit (not shown) for performing maintenance of the inkjet heads 20Y, 20M, 20C, and 20K. The maintenance unit includes a cap that covers the nozzle surfaces 22Y, 22M, 22C, and 22K of the inkjet heads 20Y, 20M, 20C, and 20K, respectively, a receiving member that receives ink droplets discharged in a preliminary (idle) discharging operation, a cleaning member that cleans the nozzle surfaces 22Y, 22M, 22C, and 22K, and a suction device that sucks ink from the nozzles. Various maintenance processes are carried out when the maintenance unit is moved to a position where the maintenance unit faces the inkjet heads 20Y, 20M, 20C, and 20K.

An image recording operation performed by the inkjet recording apparatus 10 will be described.

The recording media P are taken out from the storage unit 12 one at a time by the grippers 36 on the take-out drum 28. Each recording medium P is retained on the outer peripheral surface of the take-out drum 28, and is transported to the transfer position 44, where the recording medium P is passed from the grippers 36 on the take-out drum 28 to the grippers 36 on the transporting drum 32. Thus, the recording medium P is received by the grippers 36 on the transporting drum 32, and is transported to the image recording positions of the inkjet heads 20Y, 20M, 20C, and 20K while being retained on the outer peripheral surface of the transporting drum 32. Then, an image is formed on a recording surface of the recording medium P with ink droplets discharged from the inkjet heads 20Y, 20M, 20C, and 20K.

Subsequently, the recording medium P having the image recorded on the recording surface thereof is transported to the transport position 46, where the recording medium P is passed from the grippers 36 on the transporting drum 32 to the grippers 36 on the ejecting drum 34. Thus, the recording medium P is received by the grippers 36 on the ejecting drum 34, and is transported while being retained on the outer peripheral surface of the ejecting drum 34. Then, the recording medium P is ejected to the ejection unit 18. The image recording operation is performed in the above-described manner.

The piping structure of the inkjet recording apparatus 10 will now be described.

Figure 2:
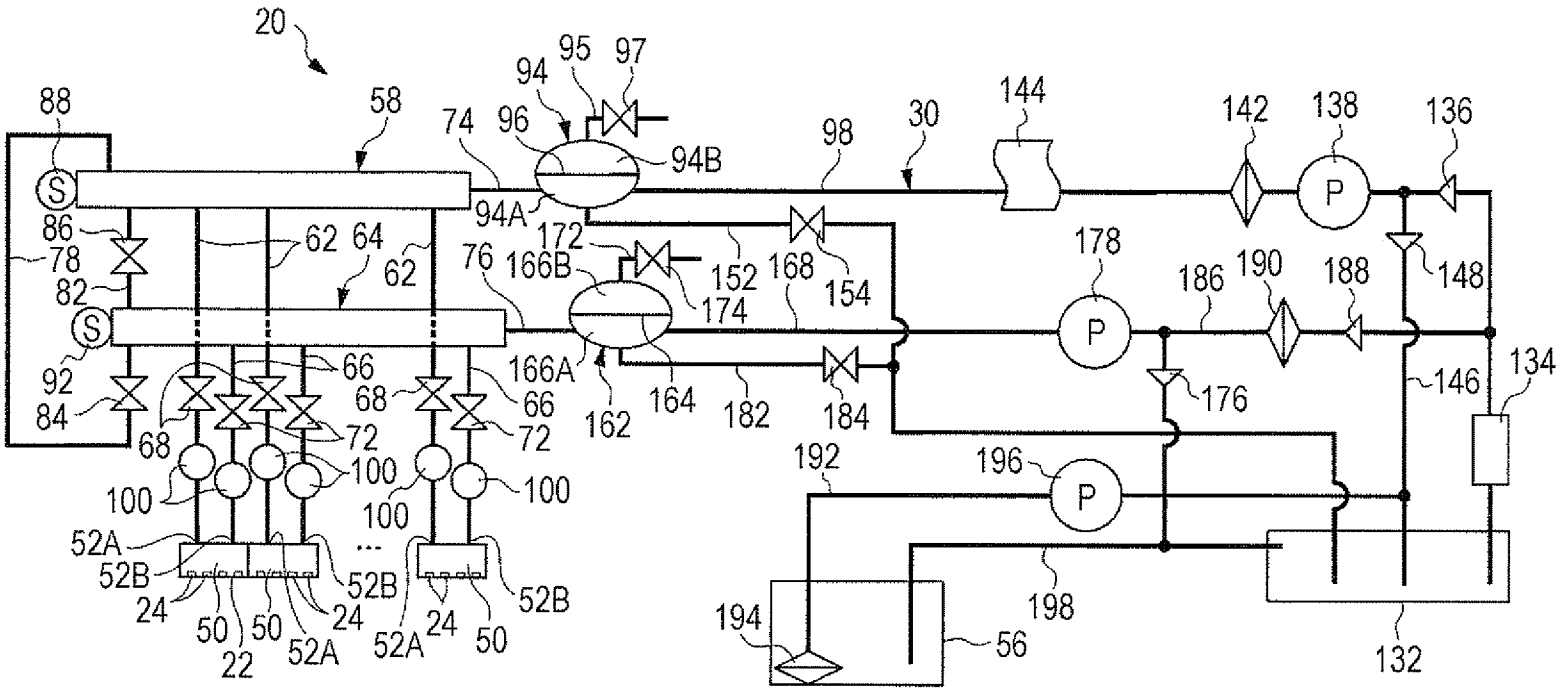
FIG. 2 is a piping diagram of an inkjet head according to the first exemplary embodiment.

FIG. 2 is a piping diagram illustrating the piping structure from each main tank 56 that contains ink to the corresponding inkjet head 20 according to the first exemplary embodiment. The piping structure includes the main tank 56, which is an example of a reservoir unit that contains ink, plural head modules 50, which are examples of droplet discharging units, and a supply channel 30 which supplies the ink from the main tank 56 to each head module 50. Each head module 50 includes plural nozzles 24 from which ink droplets are discharged. The supply channel 30 includes a supply main pipe 98, a supply pipe 74, and supply branch channels 62, which will be described below.

As illustrated in FIG. 2, each head module 50 includes an input port 52A through which the ink flows into the head module 50 and an output port 52B through which the ink flows out of the head module 50. The input port 52A is connected to an end of one of the supply branch channels 62 that extend from a supply manifold 58, and the output port 52B is connected to an end of one of collection branch channels 66, which are examples of liquid collection channels, that extend from a collection manifold 64.

The supply manifold 58 is provided with the same number of branch pipes (supply branch channels 62) as the number of head modules 50, and the collection manifold 64 is also provided with the same number of branch channels (collection branch channels 66) as the number of head modules 50. The ink supplied to the supply manifold 58 is supplied to each head module 50 at a predetermined pressure (hereinafter referred to as pressure P1) and a predetermined flow rate. The ink supplied to each head module 50 is collected from the head module 50 to the collection manifold 64 at a predetermined pressure (hereinafter referred to as pressure P2) and a predetermined flow rate.

In each head module 50, a pressure difference $\Delta P$ (=P1−P2) is generated between the pressure P1 at the supply side and the pressure P2 at the collection side, so that a back pressure P3, which is the average pressure of the sum of the pressures P1 and P2, is applied to the nozzle surface 22.

Owing to the back pressure P3, the ink is retained in the nozzles 24 in each head module 50. The ink is ejected in accordance with image information by energy-generating elements (not shown) that are capable of ejecting the ink.

Figure 4:
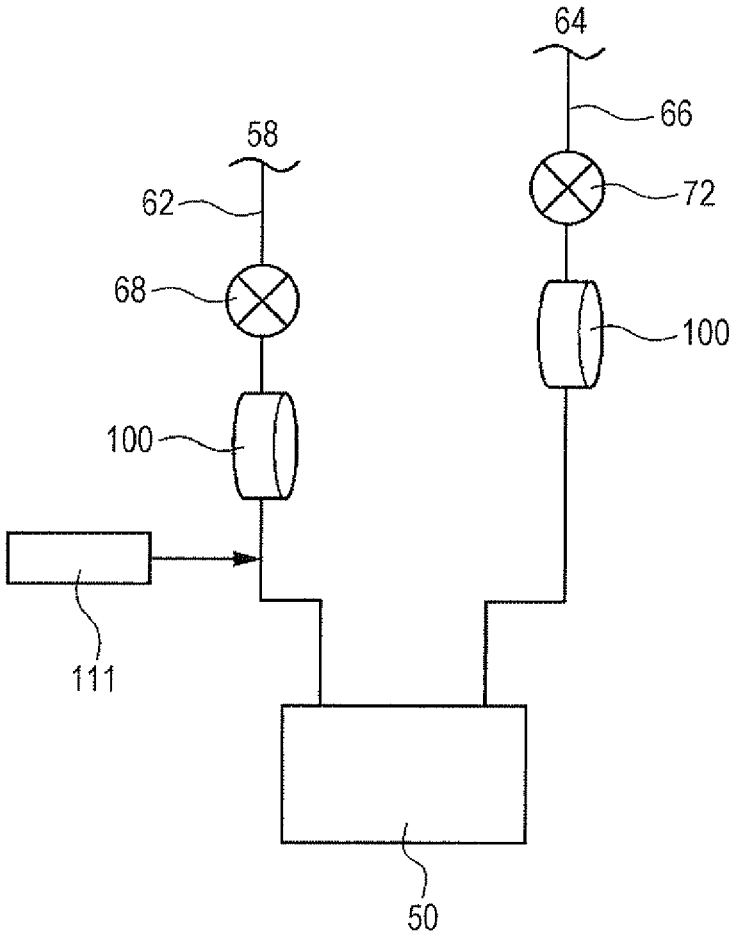
FIG. 4 is a schematic diagram illustrating the state in which a damper according to the first exemplary embodiment is provided in a supply channel.

Referring to FIG. 4, each supply branch channel 62 is provided with a supply valve 68, which is an example of a channel opening-and-closing unit, and a damper 100, which is an example of a damping device. In addition, each collection branch channel 66 is provided with a collection valve 72 and a damper 100. The supply valve 68 and the collection valve 72 are operated when the corresponding head module 50 is to be individually operated. The dampers 100 suppress the pressure variation when the ink is supplied from the supply manifold 58 or is collected to the collection manifold 64. The detailed structure of the dampers 100 will be described below.

As illustrated in FIG. 2, a first end of the supply pipe 74, which is a part of the supply channel 30, is connected to a first end (right end in FIG. 2) of the supply manifold 58 in the longitudinal direction thereof. In addition, a first end of a collection pipe 76, which is a part of an ink circulation piping system, is connected to a first end (right end in FIG. 2) of the collection manifold 64 in the longitudinal direction thereof. A first flow channel 78 and a second flow channel 82 are provided between a second end of the supply manifold 58 and a second end of the collection manifold 64.

The first flow channel 78 is provided with a first valve 84. The second flow channel 82 is provided with a second valve 86. The first flow channel 78 and the second flow channel 82 are used to adjust the pressure and ink flow rate between the supply manifold 58 and the collection manifold 64. For example, in a normal ink circulation, in which the ink flows from the supply manifold 58 to the collection manifold 64, the first valve 84 is closed and the second valve 86 is opened so that only the second flow channel 82 allows the ink to flow therethrough.

A supply pressure sensor 88 and a collection pressure sensor 92 are respectively attached to the second end of the supply manifold 58 and the second end of the collection manifold 64. The supply pressure sensor 88 monitors the pressure of the ink that flows through the supply manifold 58, and the collection pressure sensor 92 monitors the pressure of the ink that flows through the collection manifold 64.

A second end of the supply pipe 74, which is connected to the supply manifold 58, is connected to a supply sub-tank 94. The supply sub-tank 94 has a two-chamber structure, and the inner space thereof is sectioned by an elastic membrane member 96 into an ink sub-tank chamber 94A at the lower side and an air chamber 94B at the upper side. A first end of the supply main pipe 98, through which the ink is caused to flow from a buffer tank 132 connected to the main tank 56 to the ink sub-tank chamber 94A, is connected to the ink sub-tank chamber 94A. A second end of the supply main pipe 98 is connected to the buffer tank 132. An opening pipe 95 is connected to the air chamber 94B, and a supply air valve 97 is provided in the opening pipe 95.

A deaeration module 134, a one-way valve 136, a supply pump 138 for pressurizing the ink, a supply filter 142, and an ink temperature adjuster 144 are provided in the supply main pipe 98 in that order from the buffer tank 132 to the supply sub-tank 94. With these components, air bubbles are removed from the ink and the ink temperature is adjusted while the ink is supplied from the buffer tank 132 to the supply sub-tank 94 by the driving force of the supply pump 138. A branch pipe 146 branches from the supply main pipe 98 such that a first end of the branch pipe 146 is connected to an input port of the supply pump 138. The branch pipe 146 is provided with a one-way valve 148, and is connected to the buffer tank 132 at a second end thereof.

The supply pump 138 may be, for example, a tube pump that uses a stepping motor (not shown). The tube pump supplies the ink by squeezing an elastic tube containing the ink in response to the rotation of the stepping motor. However, the supply pump 138 is not limited to this type of pump. A first end of a drain pipe 152 is connected to the ink sub-tank chamber 94A, and a second end of the drain pipe 152 is connected to the buffer tank 132. The drain pipe 152 is provided with a supply drain valve 154.

The supply sub-tank 94 is structured such that air bubbles in the flow channels are trapped in the supply sub-tank 94 when the ink is circulated. The air bubbles in the supply sub-tank 94 are conveyed to the buffer tank 132 by the driving force applied by the supply pump 138 when the supply drain valve 154 is opened. Thus, the air bubbles are discharged from the buffer tank 132, which is open to the atmosphere.

A second end of the collection pipe 76, which is connected to the collection manifold 64, is connected to a collection sub-tank 162. The collection sub-tank 162 has a two-chamber structure, and the inner space thereof is sectioned by an elastic membrane member 164 into an ink sub-tank chamber 166A at the lower side and an air chamber 1663 at the upper side. A first end of a collection main pipe 168, through which the ink is caused to flow from the ink sub-tank chamber 166A to the buffer tank 132, is connected to the ink sub-tank chamber 166A. A second end of the collection main pipe 168 is connected to the buffer tank 132. An opening pipe 172 is connected to the air chamber 1663, and a collection air valve 174 is provided in the opening pipe 172.

A one-way valve 176 and a collection pump 178 are provided in the collection main pipe 168 in that order from the buffer tank 132 to the collection sub-tank 162. The ink in the collection sub-tank 162 is collected to the buffer tank 132 by the driving force of the collection pump 178. A first end of a drain pipe 182 is connected to the ink sub-tank chamber 166A, and a second end of the drain pipe 182 is connected to the drain pipe 152. The drain pipe 152 is provided with a collection drain valve 184.

The collection sub-tank 162 is structured such that air bubbles in the flow channels are trapped in the collection sub-tank 162 when the ink is circulated. The air bubbles in the collection sub-tank 162 are conveyed to the buffer tank 132 by the driving force generated by the reverse rotation of the collection pump 178 when the collection drain valve 184 is opened. Thus, the air bubbles are discharged from the buffer tank 132, which is open to the atmosphere.

In the present exemplary embodiment, the pressure P1 in the supply manifold 58 and the pressure P2 in the collection manifold 64 satisfy the relationship P1>P2. In addition, the pressures P1 and P2 are set to negative pressures. More specifically, the supply pressure applied by the supply pump 138 is a negative pressure, and the collection pressure applied by the collection pump 178 is a negative pressure that is lower than the supply pressure. Therefore, the ink flows from the supply manifold 58 to the collection manifold 64, and the back pressure P3 in the nozzles 24 of each head module 50 is maintained at a negative pressure ((P1+P2)/2). To be precise, the back pressure P3 is affected by factors such as the vertical positions of the supply manifold 58 and the collection manifold 64, the ink flow rate, and the flow channel resistance. Therefore, it is necessary to take these factors into account when setting the pressure P1 at the input side and the pressure P2 at the output side.

A pressurization purging pipe 186 is provided between the input side of the collection pump 178 and the output side of the deaeration module 134 on the supply main pipe 98. A one-way valve 188 and a collection filter 190 are provided in the pressurization purging pipe 186 in that order from the deaeration module 134 to the collection pump 178. When, for example, each head module 50 is pressurized and the ink is ejected therefrom to remove the air bubbles, the collection pump 178 is operated in the reverse direction in addition to the operation of the supply pump 138. Thus, the deaerated ink is supplied from the buffer tank 132 to the collection manifold 64.

The buffer tank 132 is connected to the main tank 56 with a replenishing pipe 192 such that the ink is allowed to flow through the replenishing pipe 192. The replenishing pipe 192 is provided with a replenishing pump 196. An amount of ink necessary for achieving the circulation of the ink is contained in the buffer tank 132, and the ink is supplied from the main tank 56 to the buffer tank 132 as the ink is consumed. A filter 194 is attached to a first end of the replenishing pipe 192 (in the main tank 56). An overflow pipe 198 is provided between the buffer tank 132 and the main tank 56. When the ink is excessively supplied, the excess ink is returned to the main tank 56 through the overflow pipe 198.

Next, a controller 200 included in the inkjet recording apparatus 10 will be described.

Figure 3:
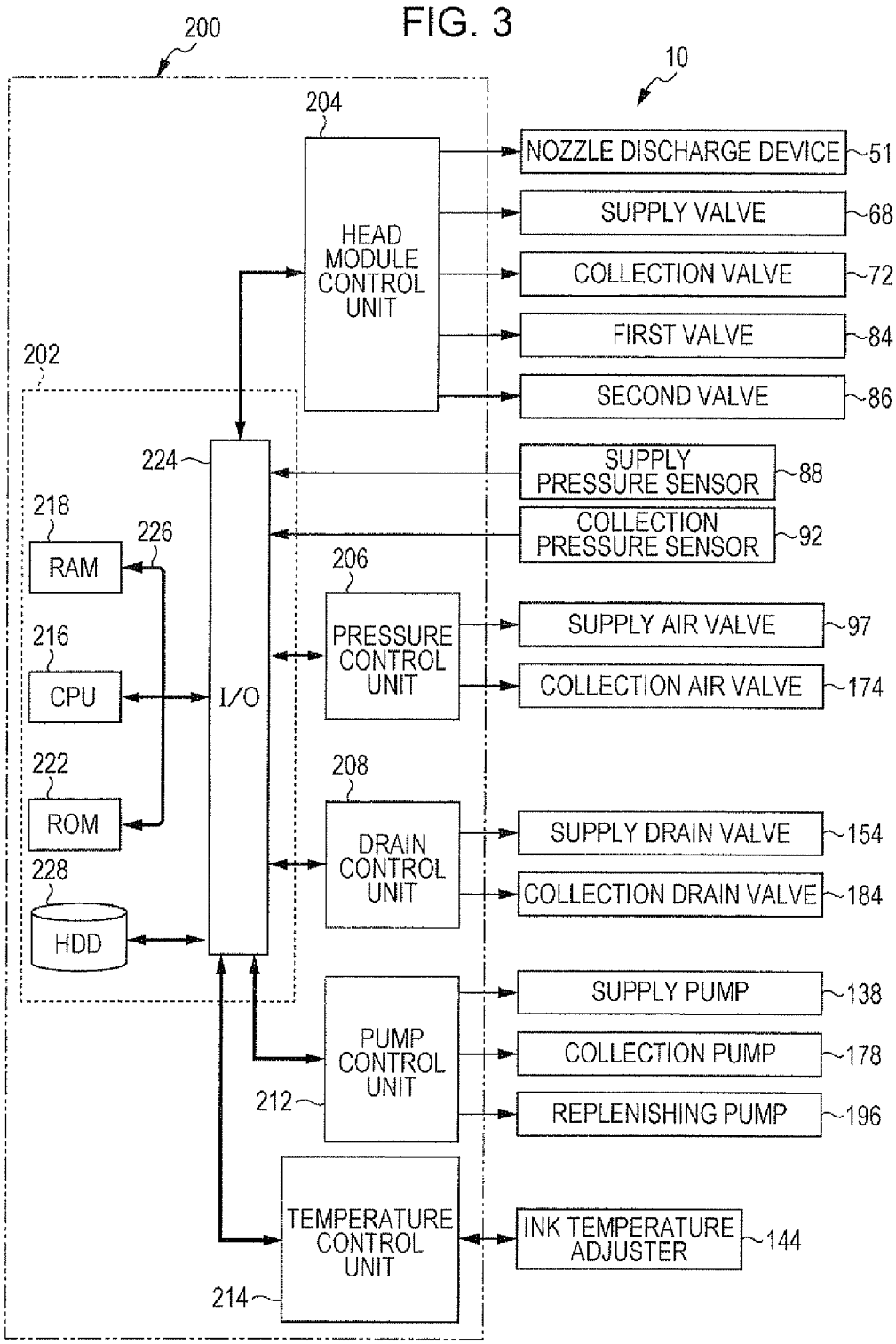
FIG. 3 is a block diagram of a controller that controls the operation of the inkjet head according to the first exemplary embodiment.

Referring to FIG. 3, the inkjet recording apparatus 10 includes the controller 200. The controller 200 performs a control operation of switching, in response to an input signal, between a discharge operation in which the ink is discharged from each head module 50 and a recovery operation in which the ink is discharged from each head module 50 at a higher pressure than that in the discharge operation.

The controller 200 includes a microcomputer 202. In addition, the controller 200 includes a head module control unit 204, a pressure control unit 206, a drain control unit 208, a pump control unit 212, and a temperature control unit 214, which are connected to the microcomputer 202. The microcomputer 202 includes a central processing unit (CPU) 216, a random access memory (RAM) 218, a read-only memory (ROM) 222, and an input/output (I/O) unit 224. The microcomputer 202 also includes a bus 226, such as a data bus or a control bus, that provides connection between the above-mentioned components.

The I/O unit 224 is connected to a hard disk drive (HDD) 228. The I/O unit 224 is also connected to the supply pressure sensor 88 and the collection pressure sensor 92. The I/O unit 224 receives image data from an external device. The image data is used when an image is formed by discharging the ink from the nozzles 24 (see FIG. 2) in each head module 50. The image data may be, for exempla, data that represents ink discharge positions and amounts of ink discharge or data compressed in JPEG format or the like. The CPU 216 reads an ink circulation programs from the ROM 222 and executes the programs.

The ink circulation programs include, for example, a circulation control program for circulating the ink in the buffer tank 132 from the supply manifold 58 to the collection manifold 64, a control program for discharging ink droplets from the nozzles 24 in accordance with the image data, and a purge control program for removing (purging) the air bubbles generated in the head module 50. The ink circulation programs may be stored in the HDD 228 instead of the ROM 222. Alternatively, the ink circulation programs may be stored in an external storage medium (not shown). In such a case, the ink circulation programs are obtained from a reader that is capable of reading information from the external storage medium when the external storage medium is attached thereto or from a network (not shown), such as a local area network (LAN).

The CPU 216 controls the operations of the head module control unit 204, the pressure control unit 206, the drain control unit 208, the pump control unit 212, and the temperature control unit 214, which are connected to the I/O unit 224, on the basis of the ink circulation programs. The head module control unit 204 is connected to a nozzle discharge device 51 (for example, a device that discharges ink droplets from the nozzles by controlling the energization of piezoelectric elements or the like and vibrating pressure chambers) which is included in each head module 50. The head module control unit 204 is also connected to the supply valve 68 and the collection valve 72 for each head module 50, the first valve 84, and the second valve 86.

The pressure control unit 206 is connected to the supply air valve 97 and the collection air valve 174. The drain control unit 208 is connected to the supply drain valve 154 and the collection drain valve 184. The pump control unit 212 is connected to the supply pump 138, the collection pump 178, and the replenishing pump 196. The temperature control unit 214 is connected to the ink temperature adjuster 144.

The dampers 100 will now be described.

The damper 100 provided in each supply branch channel 62 and the damper 100 provided in each collection branch channel 66 have the same structure. Therefore, only the damper 100 provided in each supply branch channel 62 will be described, and explanations of the damper 100 provided in each collection branch channel 66 will be omitted.

Figure 5A:
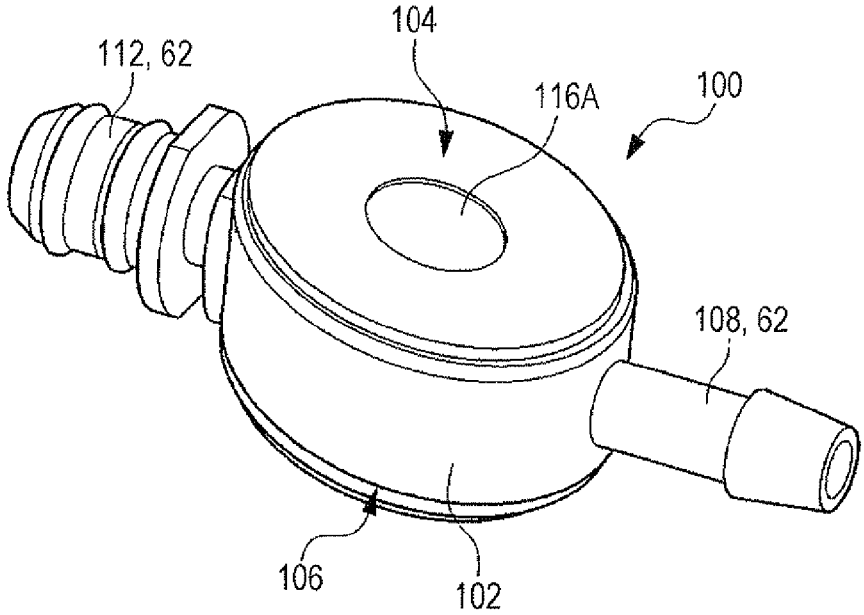
FIG. 5A is a perspective view of the damper according to the first exemplary embodiment.
Figure 5B:
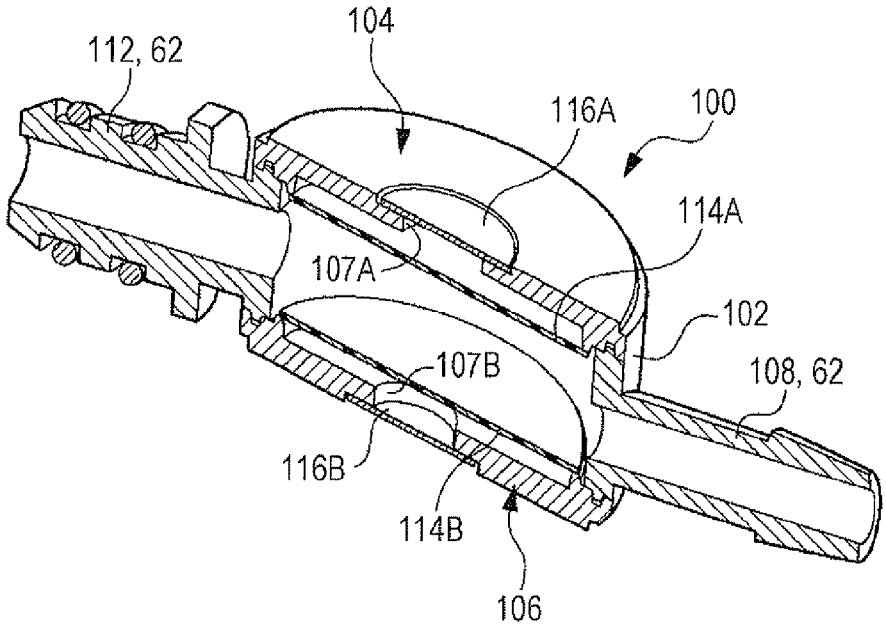
FIG. 5B is a sectional view of the damper according to the first exemplary embodiment.

Referring to FIGS. 5A and 5B, the damper 100 includes a base portion 102 that is composed of a cylindrical side wall having an elliptical shape in plan view and upper and lower covers 104 and 106, which are examples of wall portions. The upper and lower covers 104 and 106 cover the openings at the ends of the base portion 102.

The base portion 102 is provided with a cylindrical connecting portion 108 that projects outward from one end of the base portion 102 having the elliptical shape in the long-axis direction thereof and a cylindrical connecting portion 112 that projects outward from the other end of the base portion 102 in the long-axis direction thereof. The inner spaces of the connecting portions 108 and 112 communicate with the inner space of the base portion 102. The damper 100 is provided in the supply branch channel 62 such that the connecting portion 108 is connected to the head module 50 (see FIG. 4) and the connecting portion 112 is connected to the supply valve 68.

Figure 6A:
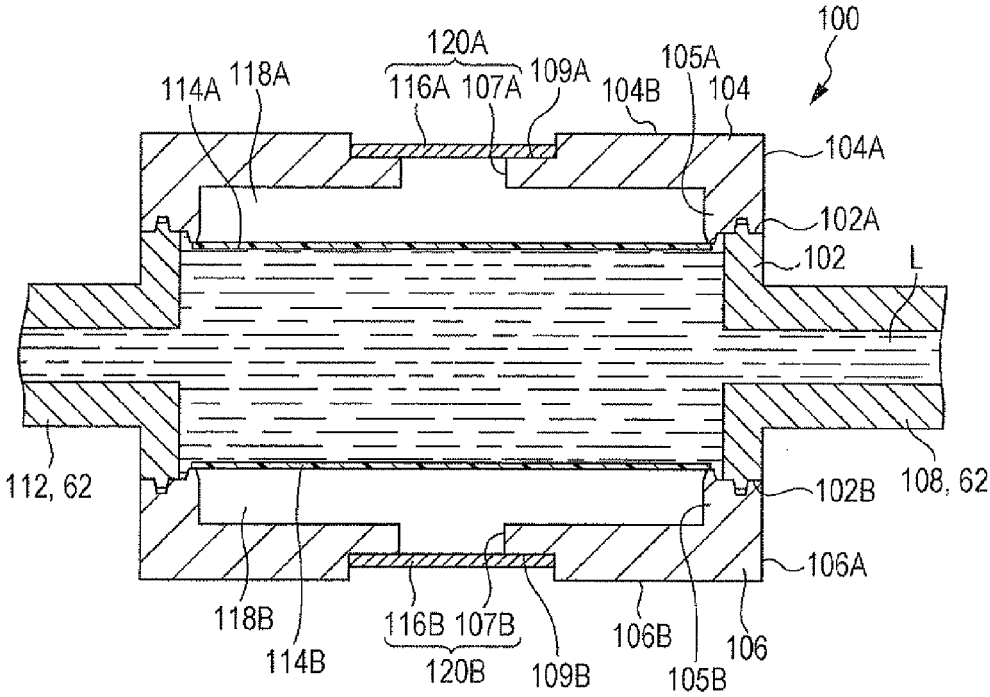
FIGS. 6A and 6B are sectional views illustrating the operation of the damper according to the first exemplary embodiment.

As shown in FIG. 6A, the upper cover 104 includes a side wall 104A that extends upward from an upper opening edge 102A of the base portion 102 and a top wall 104B that extends from the top edge of the side wall 104A toward the center of the base portion 102 in the horizontal direction. An annular support portion 105A is provided on the inner peripheral surface of the side wall 104A. The support portion 105A projects inward beyond the inner peripheral surface of the base portion 102. An outer peripheral portion of an elastic membrane 114A that has an elliptical shape in plan view is attached to the bottom end of the support portion 105A by ultrasonic welding.

A hole wall portion 107A, which is an example of a through hole portion, is formed in the top wall 104B at the center thereof in plan view. A step portion 109A that is recessed toward the elastic membrane 114A is formed along the periphery of the hole wall portion 107A at the top end thereof. A gas-liquid separation membrane 116A is attached to the step portion 109A by heat welding so as to cover the hole wall portion 107A. The gas-liquid separation membrane 116A allows air (gas) to pass therethrough and blocks ink (liquid). The hole wall portion 107A and the gas-liquid separation membrane 116A form a resistance portion 120A, which is an example of a resistance unit. The gas-liquid separation membrane 116A is made of, for example, a material having an air permeability (Gurley number determined by a Gurley permeability test according to Japanese Industrial Standard (JIS) P 8117) of 5 sec to 7 sec.

The elastic membrane 114A serves as a wall of the supply branch channel 62, and prevents the ink L from flowing out of an inner space of the base portion 102, which corresponds to an inner space of the supply branch channel 62. An air chamber 118A, which is an example of a gas chamber, is formed outside the base portion 102 in a space between the upper cover 104 and the elastic membrane 114A. More specifically, the air chamber 118A is provided between the elastic membrane 114A and the gas-liquid separation membrane 116A.

Similarly, the lower cover 106 includes a side wall 106A that extends downward from a lower opening edge 102B of the base portion 102 and a bottom wall 106B that extends from the bottom edge of the side wall 106A toward the center of the base portion 102 in the horizontal direction. A support portion 105B is provided on the inner peripheral surface of the side wall 106A. The support portion 105B projects inward beyond the inner peripheral surface of the base portion 102. An outer peripheral portion of an elastic membrane 114B that has an elliptical shape in plan view is attached to the top end of the support portion 105B.

A hole wall portion 107B, which is an example of a through hole portion, is formed in the bottom wall 106B at the center thereof in plan view. A step portion 109B that is recessed toward the elastic membrane 114B is formed along the periphery of the hole wall portion 107B at the bottom end thereof. A gas-liquid separation membrane 116B is bonded to the step portion 109B so as to cover the hole wall portion 107B. The gas-liquid separation membrane 116B allows air (gas) to pass therethrough and blocks ink (liquid). The hole wall portion 107B and the gas-liquid separation membrane 116B form a resistance portion 120B, which is an example of a resistance unit.

The elastic membrane 114B serves as a wall of the supply branch channel 62, and prevents the ink L from flowing out of an inner space of the base portion 102, which corresponds to an inner space of the supply branch channel 62. An air chamber 118B, which is an example of a gas chamber, is formed outside the base portion 102 in a space between the lower cover 106 and the elastic membrane 114B. More specifically, the air chamber 118B is provided between the elastic membrane 114B and the gas-liquid separation membrane 116B.

In the damper 100, the upper and lower covers 104 and 106, the elastic membranes 114A and 114B, and the gas-liquid separation membranes 116A and 116B are made of the same materials, and have the same shapes and dimensions. The hole wall portions 107A and 107B have the same inner diameter. Accordingly, the damper 100 have a vertically symmetrical structure with respect to the flow channel of the ink L. The amount of deformation of the gas-liquid separation membranes 116A and 116B is smaller than that of the elastic membranes 114A and 114B.

Operation

The operation of the first exemplary embodiment will be described.

Figure 6B:
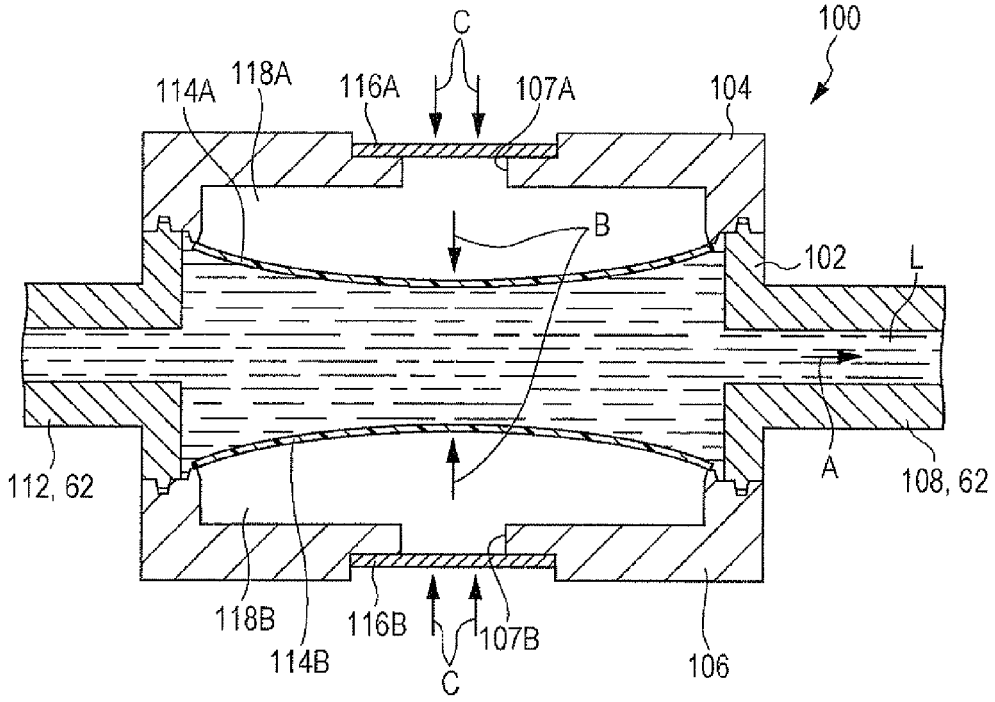

Here, it is assumed that the pressure applied to the ink in the supply branch channel 62 for each head module 50 in the inkjet head 20 illustrated in FIG. 2 is varied in response to the operation of opening the corresponding supply valve 68 or sudden consumption of the ink in the printing operation performed by the head module 50. At this time, as illustrated in FIG. 6B, a negative pressure is applied to the ink L that flows in the direction shown by arrow A, and the elastic membranes 114A and 114B are deformed inward (in the directions shown by arrows B) so that the volume of the flow channel of the ink L (inner space of the supply branch channel 62) is reduced. Thus, the pressure variation is reduced (absorbed). Although not illustrated in the figure, when a positive pressure is applied, the elastic membranes 114A and 114B swell outward (in the directions opposite to the directions shown by arrows B) so that the volume of the flow channel of the ink L (inner space of the supply branch channel 62) is increased. Thus, the pressure variation is reduced (absorbed).

A damper according to a comparative example (not illustrated) which does not have the gas-liquid separation membranes 116A and 116B will now be considered. When a recovery operation is performed to recover the print quality by applying a high pressure to each head module 50 and discharging ink from the nozzles in the head module 50, the damper according to the comparative example may cause the following problem. That is, if the elastic membranes 114A and 114B are excessively deformed, the pressure applied to the ink L in the supply branch channel 62 will become too low and the pressure cannot be reliably transmitted to the ink L at the downstream side of the supply branch channel 62.

In contrast, in the damper 100 according to the present exemplary embodiment, when the elastic membranes 114A and 114B try to swell outward, the gas-liquid separation membranes 116A and 116B exert an operational force (resistance) that limits ventilation in the directions opposite to the directions shown by arrows C (toward the outside of the damper 100). Accordingly, the pressure in the air chambers 118A and 118B is increased and the movement of the elastic membranes 114A and 114B is suppressed. Thus, reduction in the pressure applied to the ink L in the supply branch channel 62 and transmitted downstream is suppressed.

In addition, in the damper 100 according to the present exemplary embodiment, when the elastic membranes 114A and 114B swell outward, the air in the air chambers 118A and 118B passes through the gas-liquid separation membranes 116A and 116B and is discharged to the outside of the damper 100. Thus, the pressure in the air chambers 118A and 118B may be prevented from becoming excessively high. Thus, the swelling of the elastic membranes 114A and 114B is not excessively suppressed. Explanations of the case in which the elastic membranes 114A and 114B are deformed inward will be omitted. Even if the elastic membranes 114A and 114B are damaged, the gas-liquid separation membranes 116A and 116B prevent the ink L from flowing out of the damper 100.

A difference in operation between the case in which the damper 100 is present and the case in which the damper 100 is absent will be described with reference to a comparative example.

In the following descriptions, the graphs showing the measurement result of variation in the pressure applied to the ink L in a flow channel are obtained in the following manner in both the comparative example and the present exemplary embodiment. That is, referring to FIG. 4, the graphs show the relative pressure based on the measurement result obtained by a pressure sensor 111 provided in the supply branch channel 62 at a position between the head module 50 and the damper 100.

Figure 7A:
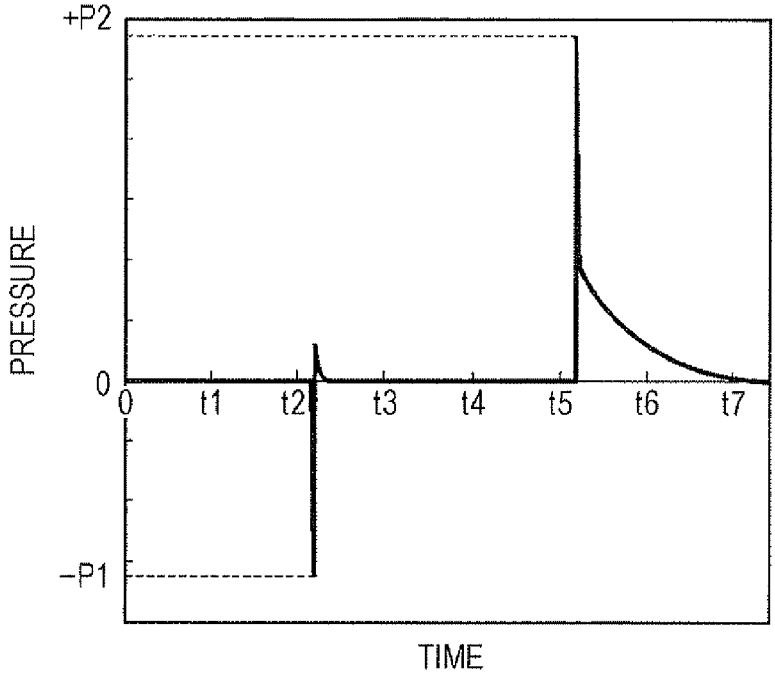
FIG. 7A is a graph showing the variation in pressure applied to ink in a supply channel according to a comparative example that does not have the damper.
Figure 7B:
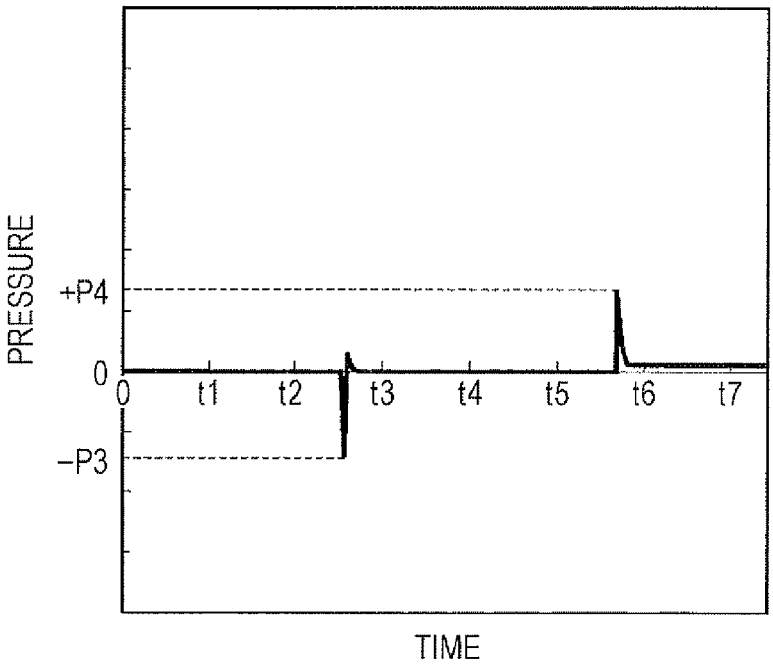
FIG. 7B is a graph showing the variation in pressure applied to ink in the supply channel having the damper according to the first exemplary embodiment.

FIGS. 7A and 7B respectively show the undesirable pressure generated in response to a valve opening-closing operation in the case where the damper 100 according to the present exemplary embodiment is not provided and that in the case where the damper 100 is provided. FIG. 7A shows the pressure variation with time in the structure in which the damper 100 is not provided in either of the supply branch channel 62 and the collection branch channel 66 for each head module 50 (see FIG. 2). FIG. 7B shows the pressure variation with time in the structure according to the present exemplary embodiment in which the damper 100 is provided in the supply branch channel 62 for each head module 50. In both of the graphs in FIGS. 7A and 7B, the supply valve 68 is opened in a period from time t2 to time t3 and is closed in a period from time t5 to time t6 while the collection valve 72 is closed. Accordingly, a negative-pressure state is established when the supply valve 68 is opened in the period from time t2 to time t3, and the sign of the pressure value changes to negative. In addition, a compressed state is established when the supply valve 68 is closed in the period from time t5 to time t6, and the sign of the pressure value changes to positive. Thus, the pressures in ink supply channels and ink collection channels vary in a short period of time in response to opening and closing of valves. This may lead to a reduction in print quality.

In FIG. 7A, the maximum pressure variations with respect to 0 in the period from time t2 to time t3 and the period from time t5 to time t6 in the comparative example that does not have the damper 100 are defined as -P1 and +P2, respectively. In FIG. 7B, the maximum pressure variations with respect to 0 in the period from time t2 to time t3 and the period from time t5 to time t6 in the present exemplary embodiment are defined as −P3 and +P4, respectively. Here, P1>P3 and P2>P4 are satisfied, which confirms that the damper 100 according to the present exemplary embodiment has a function of reducing the pressure variation.

A difference in the damping effect depending on whether or not the hole wall portions 107A and 107B and the gas-liquid separation membranes 116A and 116B are provided will be described with reference to a comparative example.

Figure 8A:
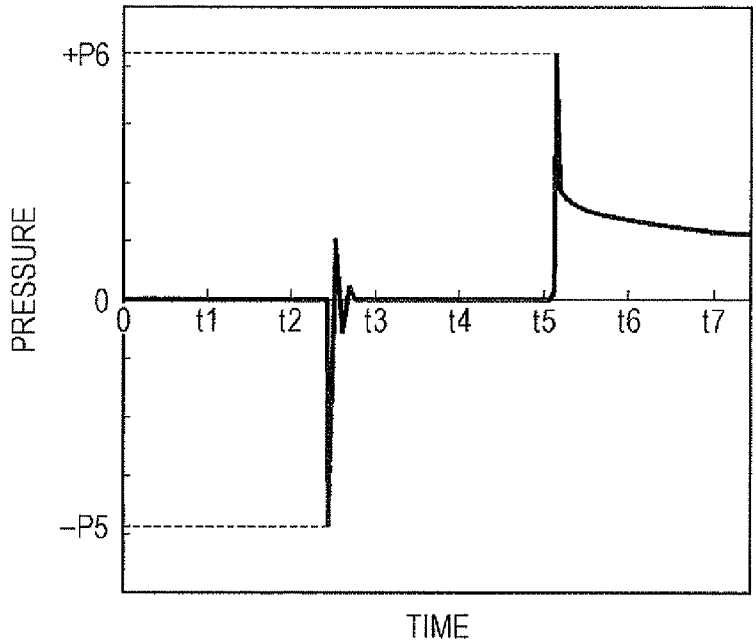
FIG. 8A is a graph showing the variation in pressure applied to ink in a supply channel according to a comparative example in which an air chamber in a damper is sealed.
Figure 8B:
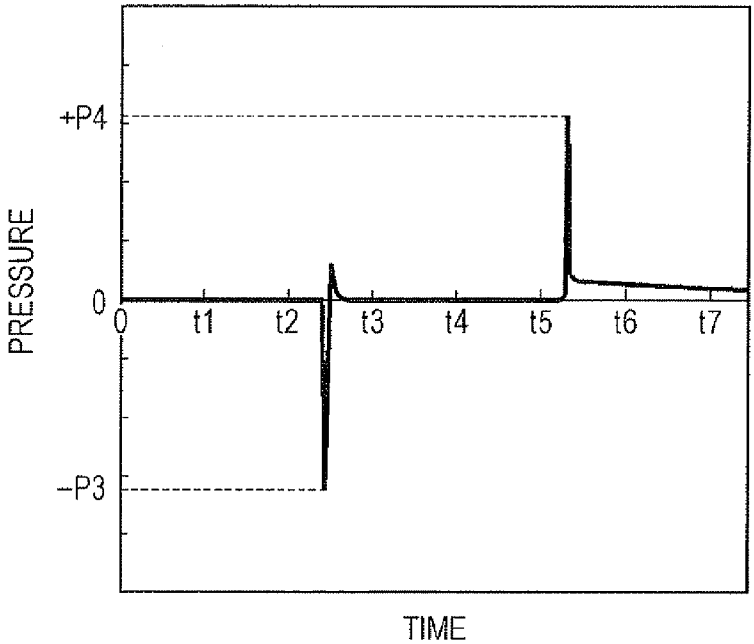
FIG. 8B is a graph showing the variation in pressure applied to ink in the supply channel having the damper according to the first exemplary embodiment.

FIG. 8A shows the pressure variation with time in the structure of a comparative example in which the hole wall portions 107A and 107B and the gas-liquid separation membranes 116A and 116B (see FIG. 6A) are not provided and in which the air chambers 118A and 118B are sealed. FIG. 8B shows the pressure variation with time in the structure provided with the damper 100 according to the present exemplary embodiment. In both of the graphs in FIGS. 8A and 8B, the collection valve 72 (see FIG. 2) is opened in a period from time t2 to time t3 and is closed in a period from time t5 to time t6 while the supply valve 68 (see FIG. 2) is closed.

In FIG. 8A, the maximum pressure variations with respect to 0 in the period from time t2 to time t3 and the period from time t5 to time t6 in the comparative example in which the air chambers 118A and 118B are sealed are defined as −P5 and +P6, respectively. Referring to FIGS. 8A and 8B, P5>P3 and P6>P4 are satisfied, which confirms that the damper 100 according to the present exemplary embodiment has a function of reducing the pressure variation. It is clear from this result that the elastic membranes 114A and 114B cannot be sufficiently deformed and satisfactory damping effect cannot be obtained when the air chambers 118A and 118B are sealed. In the structure in which the gas-liquid separation membranes 116A and 116B are provided for ventilation, excessive pressure variation in the air chambers 118A and 118B is prevented and sufficient deformability of the elastic membranes 114A and 114B is ensured. Thus, satisfactory damping effect may be obtained.

A difference in the damping effect in the recovery operation depending on whether the damper 100 is provided with the gas-liquid separation membranes 116A and 116B will be described with reference to a comparative example. In the recovery operation, the pressure is applied to the ink L so as to discharge the ink from the nozzles 24 (see FIG. 2) and unclog the nozzles 24. The recovery operation is performed by operating the supply pump 138 while the collection valve 72 is closed and the supply valve 68 is opened in each head module 50 in FIG. 2. The supply valve 68 for each head module 50 is closed after the recovery operation is finished.

Figure 9A:
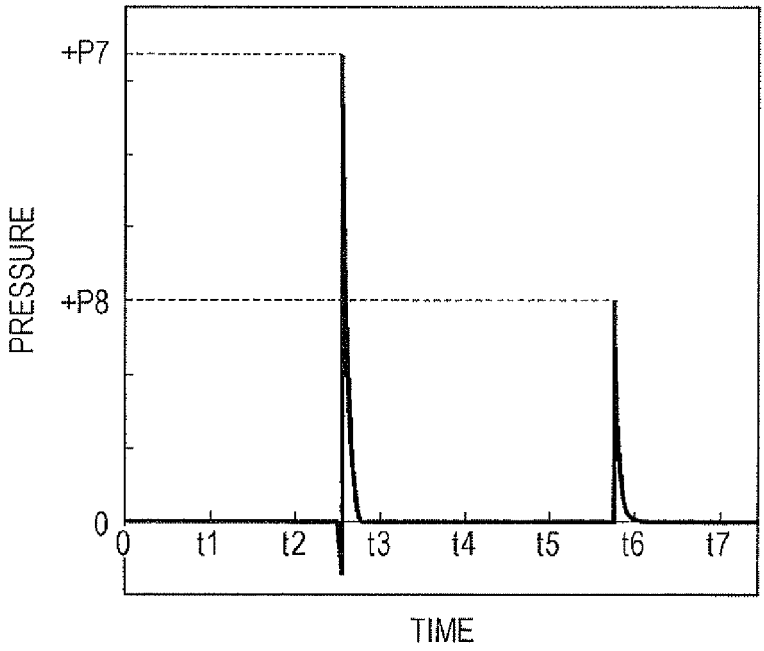
FIG. 9A is a graph showing the variation in pressure applied to ink in the supply channel having the damper according to the first exemplary embodiment when the ink is pressurized.
Figure 9B:
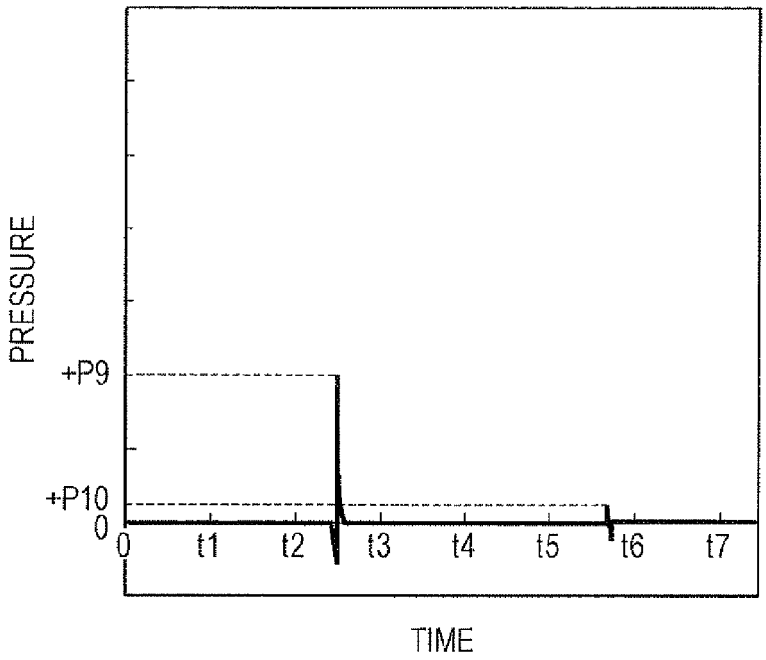
FIG. 9B is a graph showing the variation in pressure applied to ink in a supply channel according to a comparative example that does not have a gas-liquid separation membrane when the ink is pressurized.

FIG. 9A shows the pressure variation with time in the structure provided with the damper 100 according to the present exemplary embodiment during the recovery operation. FIG. 9B shows the pressure variation with time in the structure according to a comparative example during the recovery operation. In the comparative example, the gas-liquid separation membranes 116A and 116B (see FIG. 6A) are not provided and the air chambers 118A and 118B are open at the hole wall portions 107A and 107B. In both of the graphs in FIGS. 9A and 9B, the supply valve 72 (see FIG. 2) is opened in a period from time t2 to time t3 and is closed in a period from time t5 to time t6 while the collection valve 72 is closed and the supply side is pressurized. The pressure variation in the period from time t2 to time t3 is caused by the pressurization, and the pressure variation in the period from time t5 to time t6 is caused by the closing of the supply valve 72.

Referring to FIGS. 9A and 9B, when the maximum pressure variation with respect to 0 in the period from time t2 to time t3 in the present exemplary embodiment is defined as +P7 and the maximum pressure variation with respect to 0 in the period from time t2 to time t3 in the comparative example in which the air chambers 118A and 118B are open is defined as +P9, P9<P7 is satisfied. Explanations of maximum pressure variations P8 and P10 with respect to 0 in the present exemplary embodiment and the comparative example, respectively, obtained when the supply valve 72 is closed will be omitted.

It is clear from this result that when the air chambers 118A and 118B are open, excessive deformation of the elastic membranes 114A and 114B cannot be suppressed and the recovery operation pressure (transmission pressure) applied to the ink L at the downstream side of the supply branch channel 62 will be reduced. In contrast, in the structure in which the gas-liquid separation membranes 116A and 116B are provided so that the ventilation resistance is applied to the elastic membranes 114A and 114B, the pressure in the air chambers 118A and 118B increases and excessive deformation of the elastic membranes 114A and 114B is suppressed. Therefore, reduction in the pressure applied to the ink L in the supply branch channel 62 and transmitted downstream is suppressed.

Figure 10A:
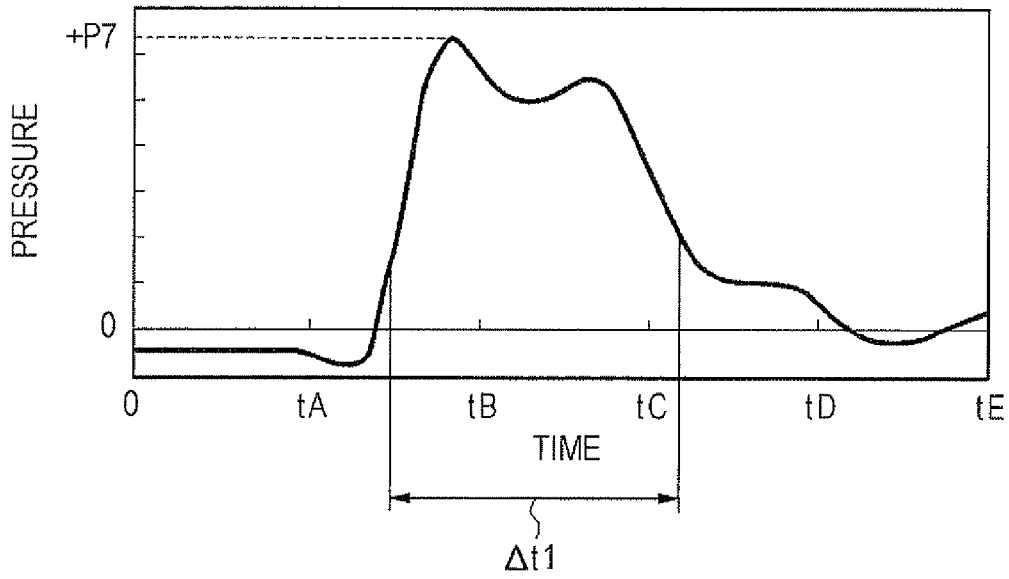
FIG. 10A is a graph in which a part of FIG. 9A is enlarged.
Figure 10B:
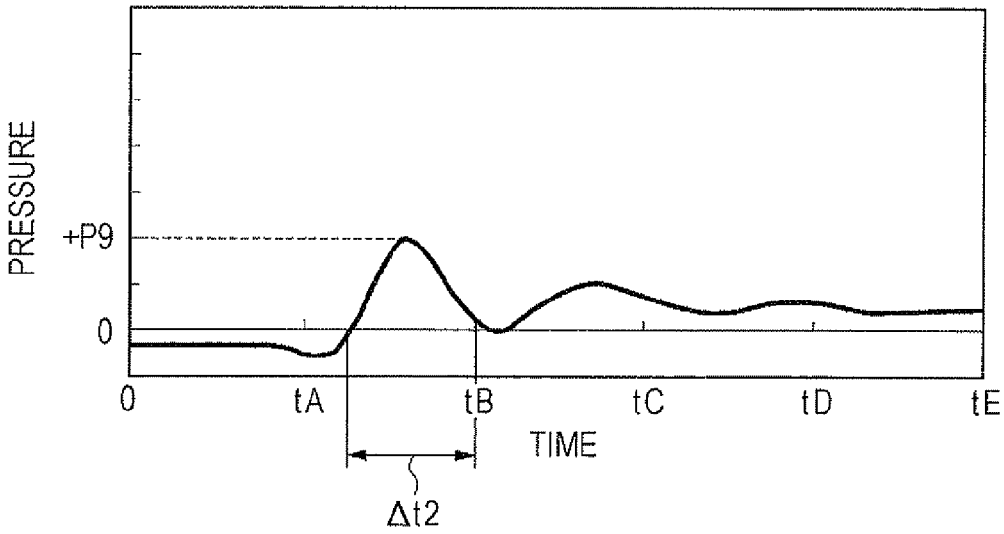
FIG. 10B is a graph in which a part of FIG. 9B is enlarged.

FIGS. 10A and 10B are graphs in which the range from time t2 to time t3 in FIGS. 9A and 9B is enlarged. In FIGS. 10A and 10B, the period from time t2 to time t3 are divided at times tA, tB, tC, tD, and tE. In FIGS. 10A and 10B, when the time period from when the pressure starts increasing to when the pressure stops decreasing in the present exemplary embodiment is Δt1 and that in the comparative example is Δt2, Δt1>Δt2 is satisfied. Thus, in the damper 100 according to the present exemplary embodiment, the pressure is applied for a longer time than in the comparative example. Thus, it is clear that the reduction in the transmission pressure applied to the ink at the downstream side for the recovery operation is smaller in the damper 100 according to the present exemplary embodiment than that in the comparative example. The pressure variation absorbed by the damper 100 according to the present exemplary embodiment is the variation of about several hundred milliseconds that is caused in response to the operation of opening or closing the valves or sudden consumption of the ink in the printing operation. The reduction in the transmission pressure is desirably suppressed when the pressure is applied for several seconds for the recovery of the print quality.

Figure 11A:
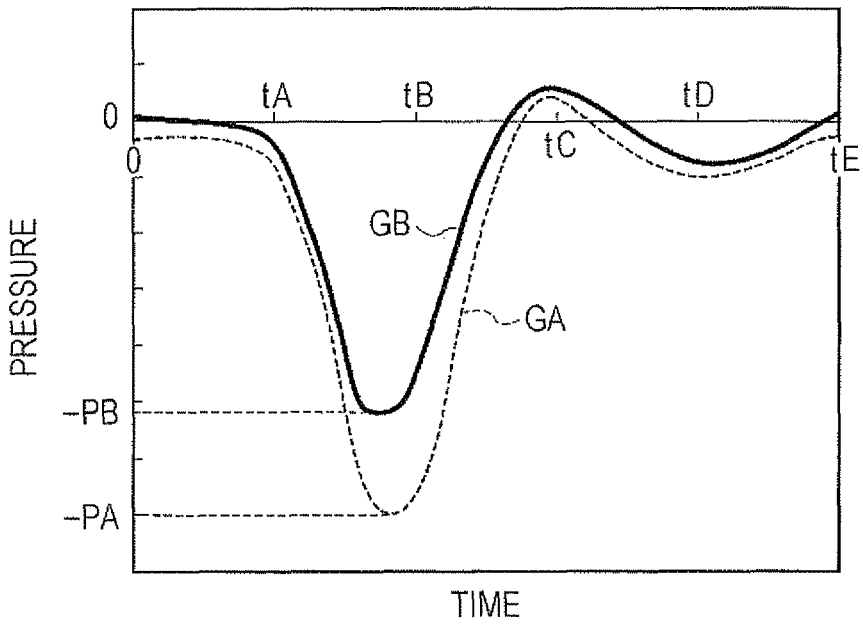
FIGS. 11A and 11B are graphs showing the variation in pressure applied to ink in the supply channel having the damper according to the first exemplary embodiment when gas-liquid separation membranes having different air permeabilities are used.
Figure 11B:
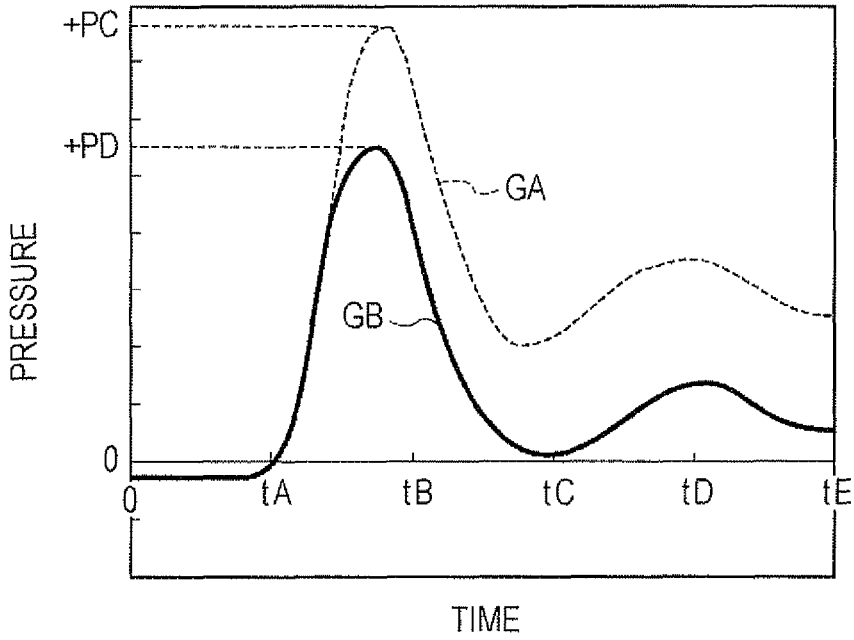

FIGS. 11A and 11B are graphs showing the pressure variation (measured by the pressure sensor 111 illustrated in FIG. 4) with time. In each graph, curve GB shows the case in which the air permeability (Gurley number determined by the Gurley permeability test according to JIS P 8117) of the gas-liquid separation membranes 116A and 116B (see FIG. 6A) included in the damper 100 is small, and curve GA shows the case in which the air permeability is large. Referring to FIGS. 11A and 11B, the maximum pressure variations with respect to 0 in curves GA are defined as −PA and +PC, and the maximum pressure variations with respect to 0 in curves GB are defined as −PB and +PD. Here, PA>PB and PC>PD are satisfied. Thus, variation in the transmission pressure applied at the downstream side is reduced as the air permeability of the gas-liquid separation membranes 116A and 116B is increased.

Second Exemplary Embodiment

A damping device, a liquid supplying apparatus, and a droplet discharging apparatus according to a second exemplary embodiment of the present invention will be described.

The damping device, the liquid supplying apparatus, and the droplet discharging apparatus according to the second exemplary embodiment have the same mechanical structures as those in the inkjet heads 20 and the inkjet recording apparatus 10 according to the first exemplary embodiment. The second exemplary embodiment differs from the first exemplary embodiment in the structure of the damper. Accordingly, inkjet heads and an inkjet recording apparatus according to the second exemplary embodiment are also denoted by reference numerals 20 and 10, respectively. In addition, components similar to those in the inkjet heads 20 and the inkjet recording apparatus 10 according to the first exemplary embodiment are denoted by the same reference numerals, and explanations thereof are thus omitted.

Figure 12:
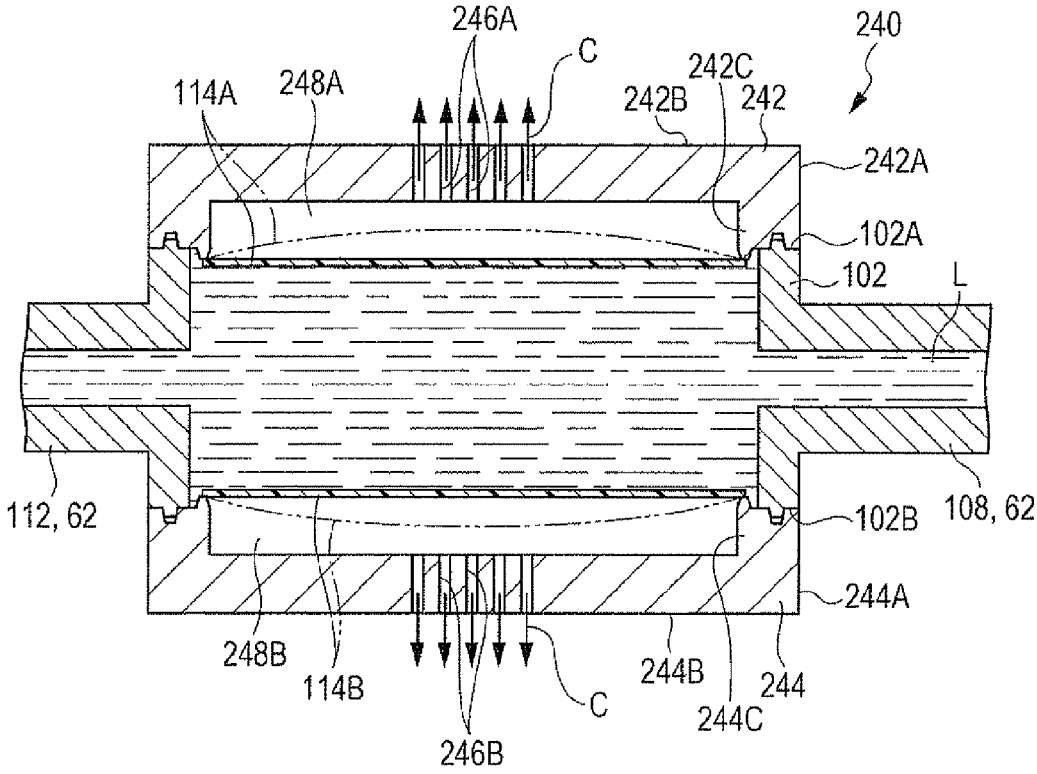
FIG. 12 is a sectional view of a damper according to a second exemplary embodiment.

FIG. 12 illustrates a damper 240 according to the second exemplary embodiment. In the damper 240, upper and lower covers 242 and 244 are provided in place of the upper and lower covers 104 and 106 (see FIG. 6A) in the damper 100. The upper cover 242 includes a side wall 242A that extends upward from an upper opening edge 102A of the base portion 102 and a top wall 242B that extends from the top edge of the side wall 242A toward the center of the base portion 102 in the horizontal direction.

A support portion 242C is provided on the inner peripheral surface of the side wall 242A. The support portion 2420 projects inward beyond the inner peripheral surface of the base portion 102. An outer peripheral portion of an elastic membrane 114A is attached to the bottom end of the support portion 242C by adhesion. An air chamber 248A, which is an example of a gas chamber, is formed outside the base portion 102 in a space between the upper cover 242 and the elastic membrane 114A. Plural hole portions 246A, which are examples of resistance units, are formed in the top wall 242B so as to extend therethrough at the center thereof in plan view. The hole portions 246A are thin through holes which allows the air in the air chamber 248A to flow out when the inner space of the air chamber 248A is pressurized. However, the hole portions 246A are drawn in FIG. 12 as if they have a large diameter.

Similarly, the lower cover 244 includes a side wall 244A that extends downward from a lower opening edge 102B of the base portion 102 and a bottom wall 244B that extends from the bottom edge of the side wall 244A toward the center of the base portion 102 in the horizontal direction. A support portion 244C is provided on the inner peripheral surface of the side wall 244A. The support portion 244C projects inward beyond the inner peripheral surface of the base portion 102. An outer peripheral portion of an elastic membrane 114B is attached to the top end of the support portion 244C by adhesion.

An air chamber 248B, which is an example of a gas chamber, is formed outside the base portion 102 in a space between the lower cover 244 and the elastic membrane 114B. Plural hole portions 246B, which are examples of resistance units, are formed in the bottom wall 244B so as to extend therethrough at the center thereof in plan view. The hole portions 246B are thin through holes which allows the air in the air chamber 248B to flow out when the inner space of the air chamber 248B is pressurized. However, the hole portions 246B are drawn in FIG. 12 as if they have a large diameter.

Operation

The operation of the second exemplary embodiment will be described.

In the damper 240 illustrated in FIG. 12 included in the inkjet head 20 illustrated in FIG. 2, when a positive pressure is applied, as in the case of valve-closing operation, the elastic membranes 114A and 114B swell outward (toward the air chambers) so that the volume of the flow channel of the ink L (inner space of the supply branch channel 62) is increased. Thus, the pressure variation is reduced (absorbed). In contrast, assume that the pressure applied to the ink in the supply branch channel 62 for each head module 50 is varied in response to the operation of opening the corresponding supply valve 68 or sudden consumption of the ink in the printing operation performed by the head module 50. At this time, a negative pressure is applied to the ink L, and the elastic membranes 114A and 114B are deformed inward (toward the ink) so that the volume of the flow channel of the ink L (inner space of the supply branch channel 62) is reduced. Thus, the pressure variation is reduced (absorbed). In addition, when a recovery operation is performed to recover the print quality by applying a high pressure to each head module 50 and discharging ink from the nozzles in the head module 50, the elastic membranes 114A and 114B try to swell outward. At this time, the pressure in the air chambers 248A and 248B is increased by the resistance applied when the air passes through the hole portions 246A and 246B in the directions shown by arrows C, and the movement of the elastic membranes 114A and 114B is suppressed. Thus, reduction in the pressure applied to the ink L in the supply branch channel 62 and transmitted downstream is suppressed.

In addition, in the damper 240, when the elastic membranes 114A and 114B swell outward, the air in the air chambers 248A and 248B passes through the hole portions 246A and 246B and is discharged to the outside of the damper 240. Thus, the pressure in the air chambers 248A and 248B is reduced. Thus, the swelling of the elastic membranes 114A and 114B is not excessively suppressed. In addition, in the valve opening operation or printing operation, the elastic membranes 114A and 114B are deformed inward so as to reduce the volume of the flow channel of the ink L. Thus, the pressure variation is reduced (absorbed).

Third Exemplary Embodiment

A damping device, a liquid supplying apparatus, and a droplet discharging apparatus according to a third exemplary embodiment of the present invention will be described.

The damping device, the liquid supplying apparatus, and the droplet discharging apparatus according to the third exemplary embodiment have the same mechanical structures as those in the inkjet heads 20 and the inkjet recording apparatus 10 according to the first exemplary embodiment. The third exemplary embodiment differs from the first exemplary embodiment in the structure of the damper. Accordingly, inkjet heads and an inkjet recording apparatus according to the third exemplary embodiment are also denoted by reference numerals 20 and 10, respectively. In addition, components similar to those in the inkjet heads 20 and the inkjet recording apparatus 10 according to the first exemplary embodiment are denoted by the same reference numerals, and explanations thereof are thus omitted.

Figure 13A:
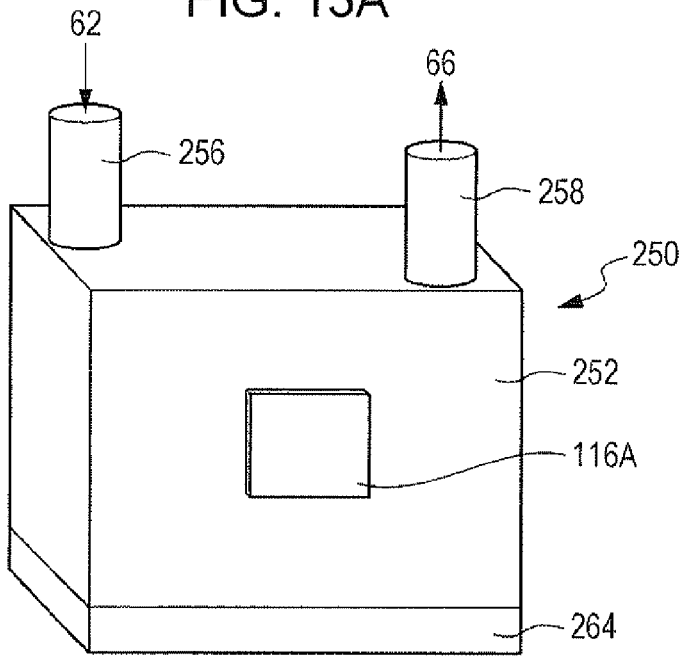
FIG. 13A is a perspective view of a damper according to a third exemplary embodiment.
Figure 13B:
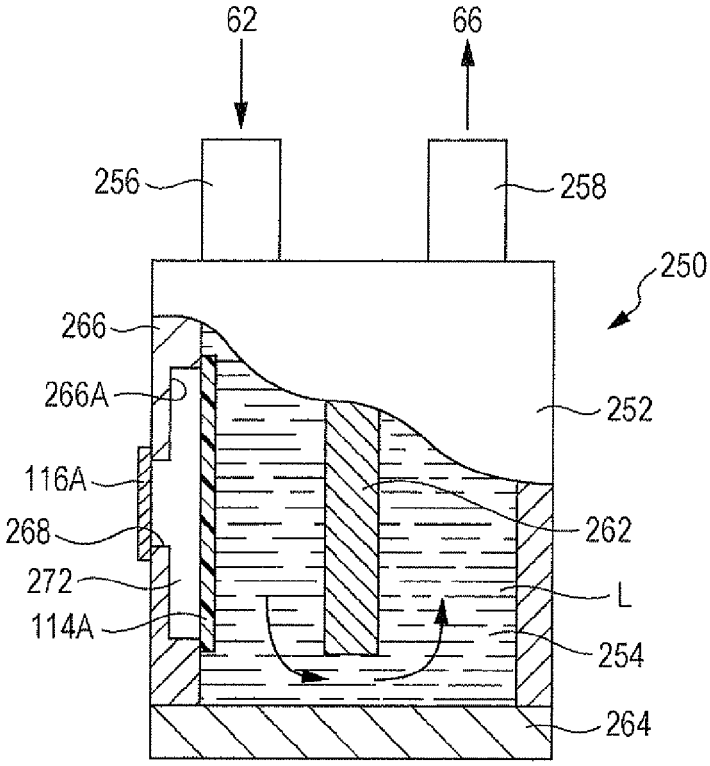
FIG. 13B is a sectional view of the damper according to the third exemplary embodiment.

FIGS. 13A and 13B illustrate a damper 250 according to the third exemplary embodiment. The damper 250 is structured such that the head module 50 and the damper 100 (see FIG. 4) according to the first exemplary embodiment are combined together. The damper 250 includes a box-shaped base portion 252 in which a flow channel 254 of the ink L is formed; a connecting portion 256 provided on the top surface of the base portion 252 and having an inner space that communicates with the flow channel 254 at an upstream end thereof; and a connecting portion 258 provided on the top surface of the base portion 252 and having an inner space that communicates with the flow channel 254 at a downstream end thereof. The connecting portion 256 is connected to the supply branch channel 62, and the connecting portion 258 is connected to the collection branch channel 66.

The base portion 252 is sectioned by a partition wall 262 that extends vertically in the base portion 252. Accordingly, the flow channel 254 is U-shaped, and a head chip unit 264 is provided at the bottom wall of the flow channel 254. The head chip unit 264 is provided with plural nozzles and plural piezoelectric elements for discharging ink droplets. The base portion 252 has a side wall 266 that defines the flow channel 254 at the side of the connecting portion 256 and that faces the partition wall 262. The side wall 266 has a recess 266A that opens toward the flow channel 254.

A through hole 268 is formed in the recess 266A at the center thereof. The through hole 268 extends from the flow channel 254 to the outside of the base portion 252. An elastic membrane 114A is attached to the opening peripheral edge of the recess 266A, and a gas-liquid separation membrane 116A is attached to the outer surface of the side wall 266 at the opening peripheral edge of the through hole 268. Thus, the inner space of the recess 266A is sealed by the elastic membrane 114A and the gas-liquid separation membrane 116A, so that an air chamber 272 is formed as an example of a gas chamber.

Operation

The operation of the third exemplary embodiment will be described.

In the damper 250 illustrated in FIG. 13B, when a positive pressure is applied, as in the case of valve-closing operation, the elastic membrane 114A swells outward (toward the air chamber) so that the volume of the flow channel of the ink L in the flow channel 254 is increased. Thus, the pressure variation is reduced (absorbed). In contrast, assume that the pressure applied to the ink is varied in response to the operation of opening the corresponding supply valve 68 or sudden consumption of the ink in the printing operation. At this time, a negative pressure is applied to the ink L, and the elastic membrane 114A is deformed inward (toward the ink) so that the volume of the flow channel of the ink L in the flow channel 254 is reduced. Thus, the pressure variation is reduced (absorbed). In addition, when a recovery operation is performed to recover the print quality by applying a high pressure to each head module 50 and discharging ink from the nozzles in the head module 50, the elastic membrane 114A swells outward. At this time, the pressure in the air chamber 272 is increased by the ventilation resistance generated by the gas-liquid separation membrane 116A, and the movement of the elastic membrane 114A is suppressed. Thus, reduction in the pressure applied to the ink L in the supply branch channel 62 and transmitted to the nozzles is suppressed.

In addition, in the damper 250, when the elastic membrane 114A swells outward, the air in the air chamber 272 passes through the gas-liquid separation membrane 116A to the outside of the damper 250. Thus, the pressure increase in the air chamber 272 is suppressed. Thus, the swelling of the elastic membrane 114A is not excessively suppressed. In addition, in the valve opening operation or printing operation, the elastic membrane 114A is deformed inward so as to reduce the volume of the flow channel of the ink L. Thus, the pressure variation is reduced (absorbed). Even if the elastic membrane 114A is damaged, the gas-liquid separation membrane 116A prevents the ink L from flowing out of the damper 250.

Fourth Exemplary Embodiment

A damping device, a liquid supplying apparatus, and a droplet discharging apparatus according to a fourth exemplary embodiment of the present invention will be described.

The damping device, the liquid supplying apparatus, and the droplet discharging apparatus according to the fourth exemplary embodiment have the same mechanical structures as those in the inkjet heads 20 and the inkjet recording apparatus 10 according to the first exemplary embodiment. The fourth exemplary embodiment differs from the first exemplary embodiment in the structure of the damper. Accordingly, inkjet heads and an inkjet recording apparatus according to the fourth exemplary embodiment are also denoted by reference numerals 20 and 10, respectively. In addition, components similar to those in the inkjet heads 20 and the inkjet recording apparatus 10 according to the first exemplary embodiment are denoted by the same reference numerals, and explanations thereof are thus omitted.

Figure 14A:
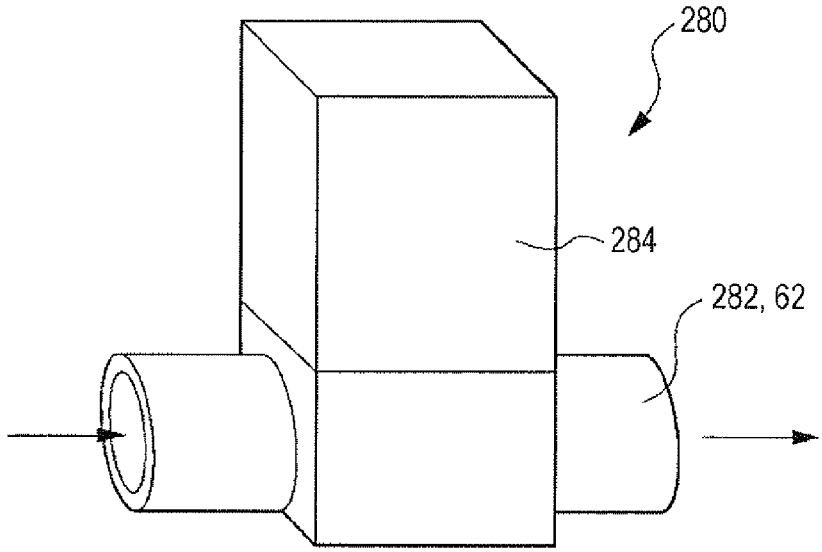
FIG. 14A is a perspective view of a damper according to a fourth exemplary embodiment.
Figure 14B:
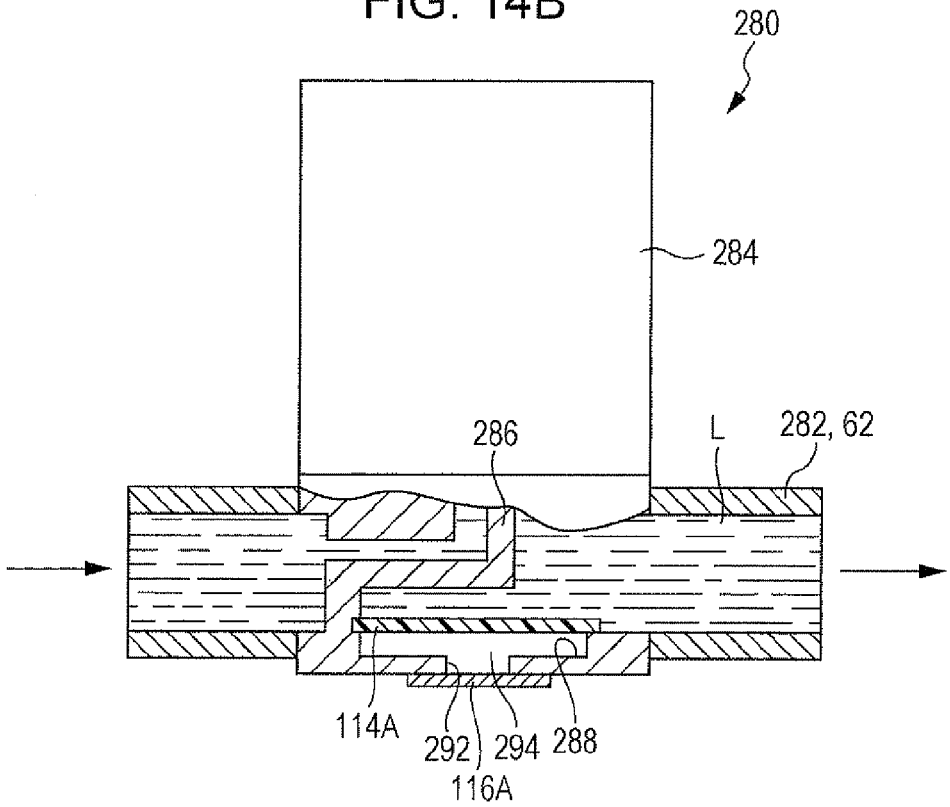
FIG. 14B is a sectional view of the damper according to the fourth exemplary embodiment.

FIGS. 14A and 14B illustrate a damper 280 according to the fourth exemplary embodiment. The damper 280 is structured such that the damper 100 and the supply valve 68 (see FIG. 4) according to the first exemplary embodiment are combined together. The damper 280 includes a flow channel 282 for the ink L and an opening-closing unit 284 that opens and closes the flow channel 282 in response to an operation of a solenoid (not shown) provided in the flow channel 282. The flow channel 282 functions as a part of the supply branch channel 62.

The flow channel 282 is sectioned by a partition wall 286 that is bent in a crank shape at a position where the opening-closing unit 284 is provided. Accordingly, the flow channel 282 is divided into an upstream section and a downstream section. A recess 288 that opens toward the flow channel 282 is formed in the bottom wall of the flow channel 282 in the section on the downstream of the opening-closing unit 284. A through hole 292 is formed in the recess 288 at the center thereof. The through hole 292 extends from the inside of the flow channel 282 to the outside thereof. An elastic membrane 114A is attached to the opening peripheral edge of the recess 288 (inside the flow channel 282), and a gas-liquid separation membrane 116A is attached to the opening peripheral edge of the through hole 292 (outside the flow channel 282). Thus, the inner space of the recess 288 is sealed by the elastic membrane 114A and the gas-liquid separation membrane 116A, so that an air chamber 294 is formed as an example of a gas chamber.

Operation

The operation of the fourth exemplary embodiment will be described.

In the damper 280 illustrated in FIG. 14B, when a positive pressure is applied, as in the case of valve-closing operation, the elastic membrane 114A swells outward (toward the air chamber) so that the volume of the flow channel of the ink L in the flow channel 282 is increased. Thus, the pressure variation is reduced (absorbed). In contrast, assume that the pressure applied to the ink is varied in response to the valve opening operation or sudden consumption of the ink in the printing operation performed by each head module 50. At this time, a negative pressure is applied to the ink L, and the elastic membrane 114A is deformed inward (toward the ink) so that the volume of the flow channel of the ink L in the flow channel 282 is reduced. Thus, the pressure variation is reduced (absorbed). In addition, when a recovery operation is performed to recover the print quality by applying a high pressure to each head module 50 and discharging ink from the nozzles in the head module 50, the elastic membrane 114A swells outward. At this time, the pressure in the air chamber 294 is increased by the ventilation resistance generated by the gas-liquid separation membrane 116A attached to the through hole 292, and the movement of the elastic membrane 114A is suppressed. Thus, reduction in the pressure applied to the ink L in the flow channel 282 and transmitted downstream is suppressed.

In addition, in the damper 280, when the elastic membrane 114A swells outward, the air in the air chamber 294 passes through the gas-liquid separation membrane 116A to the outside of the damper 280. Thus, the pressure increase in the air chamber 294 is suppressed. Thus, the swelling of the elastic membrane 114A is not excessively suppressed. In addition, in the valve opening operation or printing operation, the elastic membrane 114A is deformed inward so as to reduce the volume of the flow channel of the ink L. Thus, the pressure variation is reduced (absorbed). Even if the elastic membrane 114A is damaged, the gas-liquid separation membrane 116A prevents the ink L from flowing out of the damper 280.

The present invention is not limited to the above-described exemplary embodiments.

The droplet discharging apparatus is not limited to an inkjet recording apparatus. The droplet discharging apparatus may be, for example, a color-filter manufacturing apparatus that manufactures a color filter by discharging ink or the like onto a film or glass, an apparatus that manufactures an electroluminescence (EL) display by discharging organic EL solution onto a substrate, an apparatus that forms bumps for mounting components by discharging molten solder onto a substrate, an apparatus that forms a wiring pattern by discharging liquid containing metal, or various types of coating apparatuses that form a film by discharging droplets, as long as the droplet discharging apparatus discharges droplets.

The above-described damper 100 includes the elastic membranes 114A and 114B and the gas-liquid separation membranes 116A and 116B that are vertically symmetric to each other. However, the present invention is not limited to this, and the damper may have an elastic membrane and a gas-liquid separation membrane in only one of the upper and lower areas thereof. In addition, with regard to the number of elastic membranes 114A and 114B, plural elastic membranes maybe provided in the thickness direction. In addition, the shape of the elastic membranes may be circular or polygonal instead of elliptical. The shape of the gas-liquid separation membranes 116A and 116B may also be circular or polygonal instead of elliptical.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A damping device comprising:

an elastic membrane that serves as a wall of a part of a supply channel between a reservoir unit that contains liquid and a droplet discharging unit that discharges the liquid in the form of a droplet;

a wall portion provided outside of the supply channel such that a gas chamber is provided between the wall portion and the elastic membrane; and a resistance unit provided on the wall portion, the resistance unit providing ventilation and generating a resistance force against a movement of the elastic membrane, wherein the elastic membrane is disposed between the supply channel and the gas chamber and separates the supply channel from the gas chamber, and the resistance unit is disposed between the gas chamber and outside air and separates the gas chamber from the outside air.

2. The damping device according to claim 1, wherein the resistance unit includes a hole portion formed in the wall portion, and a gas-liquid separation membrane that covers the hole portion, the gas-liquid separation membrane allowing gas to pass therethrough and blocking the liquid.

3. A liquid supplying apparatus comprising:

the supply channel that extends between the reservoir unit that contains liquid and the droplet discharging unit that discharges the liquid in the form of a droplet; and the damping device according to claim 2, the damping device being provided in the supply channel.

4. The liquid supplying apparatus according to claim 3, further comprising:

a flow-channel opening-and-closing unit provided in the supply channel, wherein the damping device is provided in the supply channel at a position between the flow-channel opening-and-closing unit and the droplet discharging unit.

5. A droplet discharging apparatus, comprising:

liquid supplying apparatus according to claim 4; and the droplet discharging unit including a discharge orifice through which the liquid is discharged in the form of a droplet, the droplet discharging unit being disposed downstream of the damping device in the supply channel, wherein the droplet discharging apparatus performs a droplet discharging operation of discharging the liquid in the form of a droplet from the droplet discharging unit in response to an input signal and an ejecting operation of ejecting the liquid from the discharge orifice by pressurizing the supply channel at a pressure higher than a pressure applied in the discharging operation.

6. The droplet discharging apparatus according to claim 5, further comprising:

a liquid collection channel through which the liquid supplied to the droplet discharging unit is collected to the reservoir unit, wherein the damping device is provided in the liquid collection channel.

7. A droplet discharging apparatus, comprising:

the liquid supplying apparatus according to claim 3; and the droplet discharging unit including a discharge orifice through which the liquid is discharged in the form of a droplet, the droplet discharging unit being disposed downstream of the damping device in the supply channel, wherein the droplet discharging apparatus performs a droplet discharging operation of discharging the liquid in the form of a droplet from the droplet discharging unit in response to an input signal and an ejecting operation of ejecting the liquid from the discharge orifice by pressurizing the supply channel at a pressure higher than a pressure applied in the discharging operation.

8. The droplet discharging apparatus according to claim 7, further comprising:

a liquid collection channel through which the liquid supplied to the droplet discharging unit is collected to the reservoir unit, wherein the damping device is provided in the liquid collection channel.

9. A liquid supplying apparatus comprising:

the supply channel that extends between the reservoir unit that contains liquid and the droplet discharging unit that discharges the liquid in the form of a droplet; and the damping device according to claim 1, the damping device being provided in the supply channel.

10. The liquid supplying apparatus according to claim 9, further comprising:

a flow-channel opening-and-closing unit provided in the supply channel, wherein the damping device is provided in the supply channel at a position between the flow-channel opening-and-closing unit and the droplet discharging unit.

11. A droplet discharging apparatus, comprising:

liquid supplying apparatus according to claim 10; and the droplet discharging unit including a discharge orifice through which the liquid is discharged in the form of a droplet, the droplet discharging unit being disposed downstream of the damping device in the supply channel, wherein the droplet discharging apparatus performs a droplet discharging operation of discharging the liquid in the form of a droplet from the droplet discharging unit in response to an input signal and an ejecting operation of ejecting the liquid from the discharge orifice by pressurizing the supply channel at a pressure higher than a pressure applied in the discharging operation.

12. The droplet discharging apparatus according to claim 11, further comprising:

a liquid collection channel through which the liquid supplied to the droplet discharging unit is collected to the reservoir unit, wherein the damping device is provided in the liquid collection channel.

13. A droplet discharging apparatus, comprising:

the liquid supplying apparatus according to claim 9; and the droplet discharging unit including a discharge orifice through which the liquid is discharged in the form of a droplet, the droplet discharging unit being disposed downstream of the damping device in the supply channel, wherein the droplet discharging apparatus performs a droplet discharging operation of discharging the liquid in the form of a droplet from the droplet discharging unit in response to an input signal and an ejecting operation of ejecting the liquid from the discharge orifice by pressurizing the supply channel at a pressure higher than a pressure applied in the discharging operation.

14. The droplet discharging apparatus according to claim 13, further comprising:

a liquid collection channel through which the liquid supplied to the droplet discharging unit is collected to the reservoir unit, wherein the damping device is provided in the liquid collection channel.

* * * * *